US006603378B1

(12) United States Patent
Collins

(10) Patent No.: US 6,603,378 B1
(45) Date of Patent: Aug. 5, 2003

(54) MAGNETIC SWITCH ASSEMBLY

(75) Inventor: John M. Collins, Overland Park, KS (US)

(73) Assignee: Magnasphere Corp., Brookfield, WI (US)

( * ) Notice: Subject to any disclaimer, the term of this patent is extended or adjusted under 35 U.S.C. 154(b) by 0 days.

(21) Appl. No.: 10/247,170

(22) Filed: Sep. 19, 2002

(51) Int. Cl.[7] ..... H01H 9/00
(52) U.S. Cl. ..... 335/205; 335/207
(58) Field of Search ..... 335/205–208; 340/547

(56) References Cited

U.S. PATENT DOCUMENTS 5,877,664 A * 3/1999 Jackson, Jr. ..... 335/205
5,880,659 A * 3/1999 Woods ..... 335/207
5,929,731 A * 7/1999 Jackson, Jr. ..... 335/207
5,977,873 A * 11/1999 Woods ..... 340/547

* cited by examiner

*Primary Examiner*—Ramon M. Barrera
(74) *Attorney, Agent, or Firm*—Hovey Williams LLP

(57) ABSTRACT

An improved magnetic switch (10) is provided which is designed for use in an alarm circuit (52) in order to detect relative movement between first and second members such as a door (14) and frame (12), so as to signal unauthorized opening of the door (14). The switch (10) includes a switch assembly (20) for mounting in frame (12) and having first and second switch elements (40, 42), an electrically conductive shiftable body (44) adjacent the elements (40, 42), and a first attractive component (45). Additionally, the switch (10) has a second attractive component (22) for mounting to the door (14). In use when door (14) is closed and circuit (52) is armed, the magnetic attraction between body (44) and component (22) shifts the body (44) to a switch position where the body (44) is out of simultaneous contact with the switch elements (40, 42). If the door (14) is opened, the magnetic attraction between body (44) and component (45) moves the body to another switch position establishing simultaneous contact with the switch elements (40, 42).

37 Claims, 1 Drawing Sheet

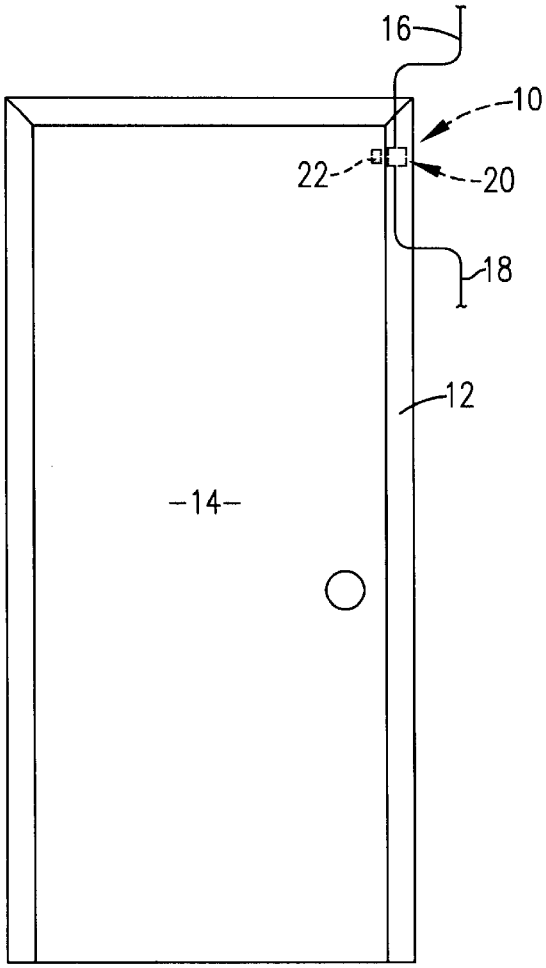
FIG. 1.
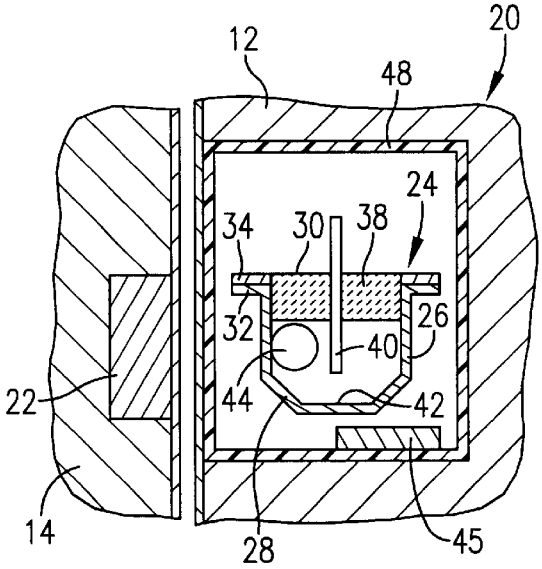
FIG. 2.
FIG. 3.
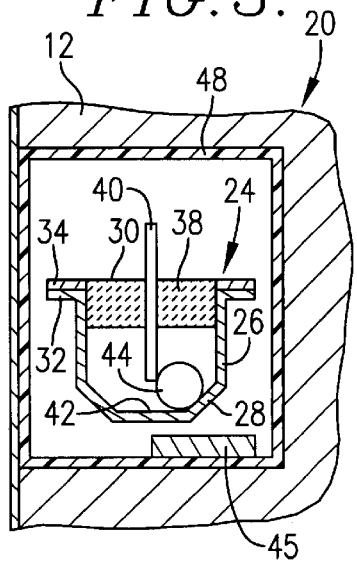
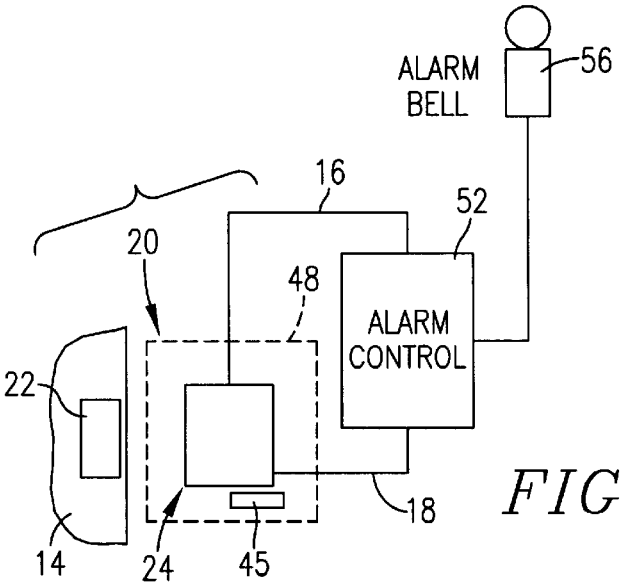
FIG. 4.

MAGNETIC SWITCH ASSEMBLY

BACKGROUND OF THE INVENTION

1. Field of the Invention

The present invention is broadly concerned with magnetic switches of the type used as a part of alarm systems for detective relative movement between first and second structural members such as a door and door frame or a window and window frame. More particularly, the invention is concerned with such switches which are especially designed to defeat attempted unauthorized external magnetic manipulation thereof. The magnetic switches of the invention include first and second spaced apart electrically conductive switch elements typically within an enclosed housing and including an electrically conductive body adjacent the contacts which can be shifted by virtue of magnetic attractions between a first position where the body simultaneously contacts both of the switch elements, and a second position where the body is out of simultaneous contact with the switch elements.

2. Description of the Prior Art

Prior art security alarm systems often make use of magnetic switches attached to doors and windows and integrated with the system for detecting unauthorized openings. One common type of magnetic switch used in these situations is a so-called reed switch. It has been found that reed switches are subject to unauthorized manipulation through use of an external magnet. Specifically, an intruder can hold a relatively strong magnet adjacent the reed switch which will then be operated (to either open or close depending on the control scheme). With this accomplished, an intruder can open the door or window without triggering the alarm system.

A number of magnetic switches have been proposed in the past to overcome the inherent deficiencies of reed switches. U.S. Pat. Nos. 5,997,873, 5,530,428, 5,332,992, 5,673,021, 5,880,659, and pending U.S. patent application Ser. No. 09/909,216 filed Jul. 19, 2001 describe switches of this type. These switches typically include a pair of spaced apart switch elements with a shiftable body (e.g., a spherical ball) movable between a first position where the ball is in simultaneous contact with both elements and a second position out of such simultaneous contact. An alarm circuit is operatively coupled with the switch elements so as to detect movement of the body. These switches represent a very significant advance in the art.

SUMMARY OF THE INVENTION

The present invention is directed to improved magnetic switches for detecting relative movement between first and second members such as doors/door frames or windows/window frames, and normally are used to detect when one of the members is moved from a first position in close adjacency with the second member, to a second position where the one member is moved to a separated open position. Broadly speaking, the magnetic switches of the invention include a switch assembly for mounting to the first member and having first and second switch elements in spaced relationship to each other, an electrically conductive body shiftable between a first body position where the body is in simultaneous contact with both of the switch elements, and a second body position where the body is out of contact with both of the switch elements. The switch assembly also includes a first magnetically attractive component adjacent the contacts in the first structural member and a second magnetically attractive component for mounting to the second member. The first and second attractive components are selected and located so that, when the first and second structural members are in the first, adjacent position, the body will be shifted to a position out of simultaneous contact with said first and second switch elements by virtue of a magnetic attraction between the body and the second attractive component; moreover, when the first and second members are in the second, separated position, the body will be shifted to a position into simultaneous contact with both of said switch elements by virtue of a magnetic attraction between the body and the first attractive component.

In preferred forms, the shiftable switch body is permanently magnetized and the first and second attractive components may be complementary magnets or formed of steel or other magnetically susceptible material. Alternately, the first and second attractive components may be permanently magnetic whereas the shiftable body is formed of steel or other material which is magnetically attractive to the components.

BRIEF DESCRIPTION OF THE DRAWINGS

FIG. 1 illustrates a preferred magnetic switch in accordance with the invention, depicted in use for protecting a door;

FIG. 2 is a vertical sectional view depicting the construction and operation of the preferred magnetic switch when the door is closed;

FIG. 3 is a vertical sectional view similar to that of FIG. 2, but illustrating the operation of the preferred magnetic switch when the door is open; and FIG. 4 is a schematic depiction of a preferred alarm system using the preferred magnetic switch device of the invention.

DETAILED DESCRIPTION OF THE PREFERRED EMBODIMENT

Turning now to the drawing, FIG. 1 illustrates a magnetic switch 10 (dashed lines) shown in use with a door frame 12 and door 14. Appropriate electrical leads 16, 18 are operatively coupled with the switch 10 as will be described below in more detail.

The switch 10 includes a switch assembly 20 designed to be secured to frame 12, as well as a second attractive component 22 which is mounted to door 14. The switch assembly 20 in preferred forms includes a housing 24 having a circumscribing annular sidewall 26, an integral concavo-convex bottom wall 28 and a top cover 30. Preferably, the integral sidewall and bottom wall 26, 28 presents a circumscribing flange 32 and is formed of a suitable electrically conductive stainless steel such as 304. The top cover 30 includes an outboard flange 34 adapted to mate with flange 32, and a central glass or ceramic nonconductive plug 38. The flange 34 is preferably formed of stainless steel.

The assembly 20 also includes an elongated, depending, substantially upright first switch element 40 which as shown extends downwardly through plug 38 to a point spaced above bottom wall 28, the latter having an annular contact surface 42 which serves as the second switch element.

A shiftable body 44 is located within housing 24 and is formed of electrically conductive material. Preferred configurations of body 44 include substantially spherical balls as well as cylinders.

The overall assembly 20 further includes a first attractive component 45 associated with housing 24. In the illustrated embodiment, the component 45 is situated slightly below and exteriorly of housing 24 and is laterally offset rightwardly relative to the central axis of the housing.

The top cover 30 is welded to sidewall 26 at the facing contact between the flanges 32 and 34, thereby creating a hermetically sealed internal chamber 46. It is preferred that the chamber 46 be filled with an inert gas such as argon.

As illustrated, the housing 24 and first attractive component 45 may be located within a mounting box 48 positioned within an appropriately sized recess in frame 12. However, such a mounting arrangement is not essential.

The second attractive component 22 is mounted to door 14, preferably along a vertical edge thereof near the top of the door. When the door 14 is closed relative to frame 12, it will be seen that the component 22 is directly in juxtaposition to housing 24. Obviously, when the door 14 is opened, the component 22 is shifted away from the housing 24.

The materials used in fabricating the first and second attractive components 45, 22 and body 44 can be varied, so long as the operational principles of the switch 10 are maintained. For example, and in preferred forms, the body 44 may be formed of a permanently magnetized material. Suitable materials include an appropriate samarium-cobalt alloy with a thin (usually about 0.001–0.002") outer coating of nickel for wear purposes or neodynium iron boron. In such an instance, the attractive components 45 and 22 may be formed of steel (e.g., partially annealed steel) or of complementary magnetized material relative to the body 44. Alternately, the first and second components 45, 22 may be formed of permanently magnetized material while the body 44 is formed of any material which is magnetically attracted to the first and second components. As explained in more detail hereafter, the goal in selecting the materials for the components 45 and 22 and body 44 is to assure that the body 44 may be appropriately magnetically shifted when the door 14 is moved between the closed and open positions thereof.

Specifically, and referring to FIG. 2, it will be seen that, when the door 14 is closed relative to frame 12, the body 44 is shifted laterally by virtue of a magnetic attraction between the second attractive component 22 and the body 44, so as to hold the body 44 in the FIG. 2 position out of simultaneous contact with the switch elements 40, 42. Of course, in this orientation, the magnetic attraction between component 22 and body 44 is greater than and overcomes the magnetic attraction between body 44 and first attractive component 45. The offset position of the component 45 augments this differential attraction relative to body 44.

When the door 14 is open so that second attractive component 22 is remote from the switch assembly 20, the body 44 is magnetically shifted to the FIG. 3 position thereof, i.e., in simultaneous contact with the switch elements 40, 42. As will be readily understood, this shifting is effected because of the magnetic attraction between the body 44 and first attractive component 45.

FIG. 4 illustrates a conventional hookup of switch 10 within an alarm circuit 52. In particular, the housing 24 is electrically coupled with a conventional alarm control 54, that is lead 16 is operatively coupled with first switch element 40 and lead 18 is coupled with the second switch element 42, with both leads connected to control 54. The alarm circuit 52 in the illustrated embodiment is configured so that when door 14 is closed, the body 44 is in the FIG. 2 position, and no alarm signal is generated. However, when the door 14 is opened and the body 44 is shifted to the FIG. 3 position, such a signal is generated. An alarm bell 56 or similar output device is typically connected with control 54.

It will thus be appreciated that if an intruder uses an external magnet (not shown) in an attempt to defeat switch 10 while door 14 is closed, the body 44 is moved because of the magnetic attraction between such external magnet to the FIG. 3 position. Specifically, a magnet placed adjacent frame 12 in proximity to switch assembly 20 when door 14 is closed will have the effect of shifting body 44 to the first position thereof in simultaneous contact with switch elements 40, 42. Consequently, any such attempt to defeat the switch 10 will immediately set off the alarm.

As explained above, the relative magnetic strengths or susceptibilities of the first and second components 45, 22 relative to body 44 must be considered in the design of switch 10. That is, the magnetic attraction generated between the body 44 and component 22 when the door 14 is closed must be significantly stronger than the countervailing magnetic attraction between the body 44 and the first component 45.

I claim:

1. A magnetic switch for detecting relative movement between first and second members, said switch comprising:

a switch assembly for mounting to the first member, including a first switch element, a second switch element in spaced relationship to the first element, an electrically conductive substantially spherical ball, and a first attractive component, said ball shiftable between a first position where the ball is in simultaneous contact with said first and second switch elements, and a second position where the ball is out of said simultaneous contact with both of the switch elements; and a second attractive component for mounting to said second member, said first and second attractive components being selected and located so that, when the first and second members are in an initial relative orientation wherein the second attractive component is proximal to said switch assembly, said ball will be shifted to said second position thereof by virtue of a magnetic attraction between said ball and said second attractive component, and so that, when the first and second members are in a different relative orientation wherein the second attractive component is remote from the switch assembly, said ball is shifted to said first position thereof by virtue of a magnetic attraction between the ball and said first attractive component.

2. The switch of claim 1, said first attractive component formed of partially annealed steel.

3. The switch of claim 2, said switch assembly including a closed housing, said first attractive component being associated with said housing.

4. The switch of claim 3, said first attractive component being formed separately of said housing and proximal thereto.

5. The switch of claim 3, said housing including a cover formed of non-conductive material.

6. The switch of claim 1, said second attractive component comprising a ferromagnetic component.

7. The switch of claim 6, said ferromagnetic component being a permanent magnet.

8. The switch of claim 1, said ball being formed of a permanently magnetized material.

9. The switch of claim 8, said ball formed of a material selected from the group consisting of samarium-cobalt alloy and neodynium iron boron.

10. The switch of claim 1, said first and second attractive components being formed of permanently magnetized material, said ball being formed of a material which is magnetically attracted to the first and second attractive components.

11. The switch of claim 1, said first switch element presenting an elongated, rod-like configuration which is oriented in a substantially upright manner, said second switch element being substantially disc-like with the second switch element disposed below the first switch element and generally transverse to the longitudinal axis of the first switch element.

12. The switch of claim 11, said second switch element presenting a concave surface adjacent said first switch element.

13. A magnetic switch for detecting relative movement between first and second members when the members are moved from a first, substantially adjacent position to a second position where the members are separated, said switch comprising:

a switch assembly for mounting to the first member, including a housing presenting a chamber with a circumscribing sidewall, a concavo-convex bottom wall, and a top cover, said top cover including a relatively weak first attractive component, said bottom wall having a contact surface;

an elongated, electrically conductive element extending downwardly through said top cover and into said chamber, said elongated element and said contact surface defining first and second switch elements, respectively; and a shiftable body within said chamber, said body shiftable between a first position where the body is in simultaneous contact with said first and second switch elements, and a second position where the body is out of said simultaneous contact with both of the switch elements; and a second attractive component for coupling to said second member, said first and second attractive components being selected and located so that, when the first and second members are in an initial relative orientation wherein the second attractive component is proximal to said switch assembly, said body will be shifted to said second position thereof by virtue of a magnetic attraction between said body and said second attractive component, and so that, when the first and second members are in a different relative orientation wherein the second attractive component is remote from the switch assembly, said body is shifted to said first position thereof by virtue of a magnetic attraction between the body and said first attractive component.

14. The switch of claim 13 said first attractive component formed of partially annealed steel.

15. The switch of claim 14, said first attractive component being associated with said housing.

16. The switch of claim 15, said first attractive component being formed separately of said housing and proximal thereto.

17. The switch of claim 15, said housing including a cover formed of non-conductive material.

18. The switch of claim 13, said second attractive component comprising a ferromagnetic component.

19. The switch of claim 18, said ferromagnetic component being a permanent magnet.

20. The switch of claim 13, said body comprising a substantially spherical ball.

21. The switch of claim 13, said body being formed of a permanently magnetized material.

22. The switch of claim 21, said body formed of a material selected from the group consisting of samarium-cobalt alloy and neodynium iron boron.

23. The switch of claim 13, said first and second attractive components being formed of permanently magnetized material, said body being formed of a material which is magnetically attracted to the first and second attractive components.

24. The switch of claim 13, said first switch element presenting an elongated, rod-like configuration which is oriented in a substantially upright manner, said second switch element being substantially disc-like with the second switch element disposed below the first switch element and generally transverse to the longitudinal axis of the first switch element.

25. The switch of claim 24, said second switch element presenting a concave surface adjacent said first switch element.

26. A magnetic switch for detecting relative movement between first and second members, said switch comprising:

a switch assembly for mounting to the first member, including a first switch element, a second switch element in spaced relationship to the first element, an electrically conductive body and a first attractive component, said body shiftable between a first position where the body is in simultaneous contact with said first and second switch elements, and a second position where the body is out of said simultaneous contact with both of the switch elements; and a second attractive component for mounting to said second member, said first and second attractive components being selected and located so that, when the first and second members are in an initial relative orientation wherein the second attractive component is proximal to said switch assembly, said body will be shifted to said second position thereof by virtue of a magnetic attraction between said body and said second attractive component, and so that, when the first and second members are in a different relative orientation wherein the second attractive component is remote from the switch assembly, said body is shifted to said first position thereof by virtue of a magnetic attraction between the body and said first attractive component, said first switch element presenting an elongated, rod-like configuration which is oriented in a substantially upright manner, said second switch element disposed below the first switch element and generally transverse to the longitudinal axis of the first switch element.

27. The switch of claim 26, said second switch element comprising a substantially disc-like portion.

28. The switch of claim 26, said first attractive component formed of partially annealed steel.

29. The switch of claim 28, said switch assembly including a closed housing, said first attractive component being associated with said housing.

30. The switch of claim 29, said first attractive component being formed separately of said housing and proximal thereto.

31. The switch of claim 29, said housing including a cover formed of non-conductive material.

32. The switch of claim 26, said second attractive component comprising a ferromagnetic component.

33. The switch of claim 32, said ferromagnetic component being a permanent magnet.

34. The switch of claim 26, said body comprising a substantially spherical ball.

35. The switch of claim 26, said body being formed of a permanently magnetized material.

36. The switch of claim 35, said body formed of a material selected from the group consisting of samarium-cobalt alloy and neodynium iron boron.

37. The switch of claim 26, said first and second attractive components being formed of permanently magnetized material, said body being formed of a material which is magnetically attracted to the first and second attractive components.

* * * * *